United States Patent [19]

Rohde

[11] Patent Number: 4,641,694

[45] Date of Patent: Feb. 10, 1987

[54] TREE FELLING, LOG CUTTING AND SPLITTING MACHINE

[76] Inventor: Kenneth A. Rohde, 3950 C.R. 195, Clyde, Ohio 43410

[21] Appl. No.: 819,588

[22] Filed: Jan. 17, 1986

[51] Int. Cl.[4] ..... B27L 7/00

[52] U.S. Cl. ..... 144/3 K; 144/34 E; 144/193 A; 144/366

[58] Field of Search ..... 144/3 K, 193 R, 193 A, 144/34 E

[56] References Cited

U.S. PATENT DOCUMENTS

| | | | |
|---|---|---|---|
| Re. 31,481 | 1/1984 | Choat | 144/34 E |
| 3,056,267 | 10/1962 | McRee | 144/134 E |
| 3,421,558 | 1/1969 | Thompson | 144/34 E |
| 4,398,581 | 8/1983 | Aikins et al. | 144/366 |

*Primary Examiner*—W. D. Bray
*Attorney, Agent, or Firm*—Richard C. Darr

[57] ABSTRACT

A machine for felling standing trees, cutting logs into segments of the desired length and splitting logs lengthwise. A shear blade is mounted for reciprocal movement within a framework by means of a hydraulic cylinder or cylinders so as to urge the log against an anvil at the rear of the frame upon the forward cutting stroke. The frame is pivotably affixed to the drawbar lift assembly of a tractor so as to be rotatable between a horizontal attitude for felling standing timber and a vertical or upright attitude for cutting and splitting logs. The anvil is pivotably connected to the frame, and includes an operating mechanism whereby it can be swung open to admit a standing tree and then closed and latched to sever the tree. The cutting edge of the shear blade is in the form of a V-shaped notch so that the log is stabilized while being severed in opposed directions upon the forward, cutting stroke. A saddle moveable along the frame with the shear blade laterally stabilizes the blade and, upon retraction of the blade, dislodges logs which may become stuck thereon.

17 Claims, 6 Drawing Figures

TREE FELLING, LOG CUTTING AND SPLITTING MACHINE

BACKGROUND OF THE INVENTION

1. Field of the Invention

This invention pertains generally to the preparation of firewood for burning in stoves, furnaces, fireplaces and the like, and more particularly to an attachment for use with tractors having conventional rear hitch or lift assemblies and which is adapted to fell standing timber, cut logs transversely to selected firewood lengths and split the cut logs lengthwise.

2. Description of the Prior Art

Numerous tractor mounted devices have been proposed for use in the lumber, pulpwood and firewood industry for felling standing timber. Such machines are disclosed, for example, in U.S. Pat. Nos. 3,421,558 to Thompson; 4,384,599 to Dagenais and Re. 31,481 to Choat. These prior art devices have generally been relatively complex so as to be expensive, and thus their use has been generally limited to commercial wood harvesting operations. Still other devices have been proposed for splitting logs or for cutting the logs into segments of the desired length and then splitting them lengthwise. U.S. Pat. Nos. 4,273,171 to Spaulding; 4,428,409 to Roetzler and 4,454,899 to Myers are exemplary of numerous such devices which can split, or cut and split, logs but which are not adapted for felling standing timber.

There has been a recognized need for a device capable of performing all three functions and which would yet be economically available to the ordinary person having access to a tractor for occasional use in making firewood. U.S. Pat. No. 4,398,581 to Aikins et al discloses a tractor mounted tree processing apparatus by which standing timber can be felled, cut to length, and the resulting logs split longitudinally to the desired size. While the device is capable of performing all three functions, it is relatively complex and requires the fabrication of a considerable number of costly specialized parts in its manufacture. There has thus not been available heretofore a tractor mounted device capable of performing all three functions which is durable, uncomplicated and relatively inexpensive to manufacture.

SUMMARY OF THE INVENTION

The present invention includes a frame pivotably affixed to the drawbar lift assembly of a tractor and rotatable between a generally horizontal attitude for felling standing timber and a vertical attitude for cutting and splitting logs. A shear blade is mounted within the frame for reciprocable movement by means of a hydraulic cylinder or cylinders so as to urge the log against an anvil at the rear of the frame upon the forward cutting stroke. The anvil is pivotably connected at one end to the frame so that it can be swung open to admit a standing tree and then closed and latched to sever the tree. The anvil and latch are connected to a remotely operable hydraulic cylinder whereby upon retraction of the piston thereof the latch is first released and the anvil is then swung open. As the piston is extended the anvil moves to the closed position and the latch locks it in place. Both the anvil and the blade may be manipulated from the seat of the tractor so that the operator can fell trees unassisted. The frame can be tilted by means of the tractor drawbar lift mechanism to cause the severed tree to fall away from the tractor.

The device is fabricated almost entirely from standard structural components cut to length and welded together, with a minimum of other machine work, so that it can be inexpensively assembled with basic fabricating equipment. The cutting edge of the shear blade has an angular recess for stablizing the tree or log as it is forced against the anvil during the forward, cutting stroke while progressively shearing the log in opposed directions.

It is therefore a primary object of the present invention to provide a tractor mounted apparatus readily adapted to fell standing trees, cut logs to length, and longitudinally split the cut logs.

Another object of the invention is to provide such a device carried by the conventional drawbar lift assembly of a tractor and operated by the hydraulic system of the tractor.

Another object of the invention is to provide such a device which is durable and uncomplicated in use.

Still another object is to provide such a device fabricated from conventional structural components so as to be of economical construction.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENT

Figure 1:
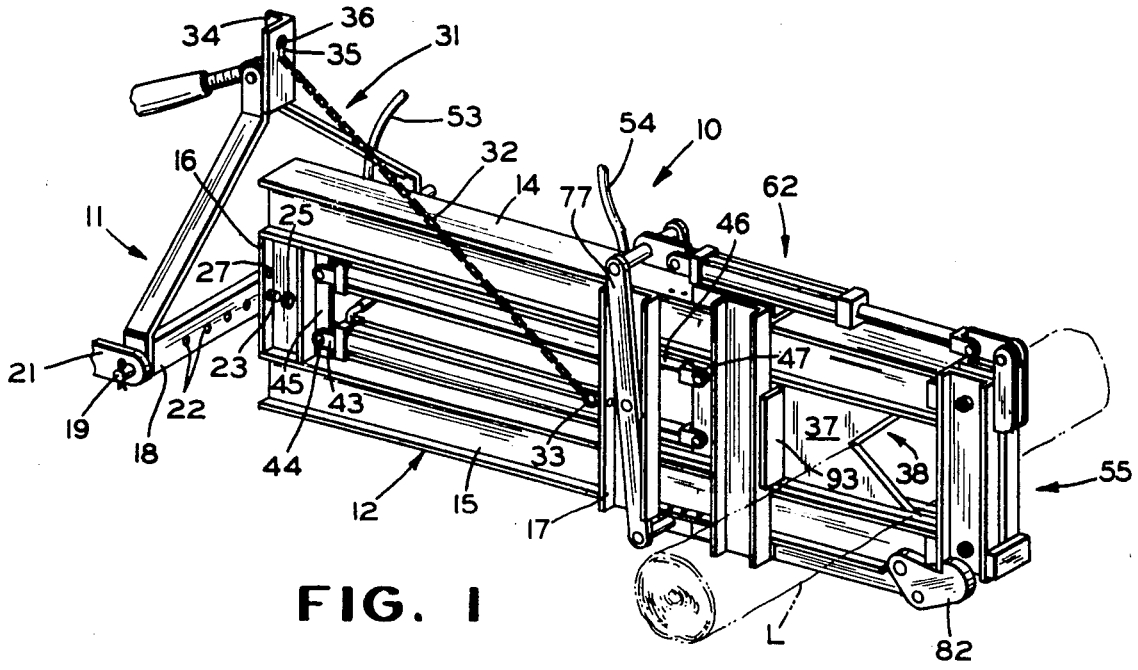
FIG. 1 is a perspective view showing the invention carried by the drawbar lift assembly of a tractor, with the shear blade in position for cutting a log to length.

Referring now to the drawings, and in particular to FIG. 1, there is shown generally at 10 a felling, cutting and splitting device contructed in accordance with the invention attached to the drawbar lift assembly 11 of a suitable tractor (not shown). The device 10 includes a generally rectangular framework 12 within which is mounted a guillotine type shearing mechanism 13. As best shown in FIG. 1, the framework 12 includes upper and lower beam members 14 and 15, respectively, such as conventional wide flange beams, interconnected at their forward ends by a similar beam section 16. The framework is preferably assembled by welding throughout unless otherwise specified, but it will be readily appreciated that the members may also be fastened in other ways as, for example, by bolts. Intermediate their ends the beams 15 and 16 are interconnected along the edges of their flanges in spaced parallel relationship by a pair of outwardly facing channel sections 17. The beams 14 and 15, and beam 16 and channel sections 17 thus define a rigid framework within which the shearing mechanism 13 functions as will be hereinafter described.

Figure 6:
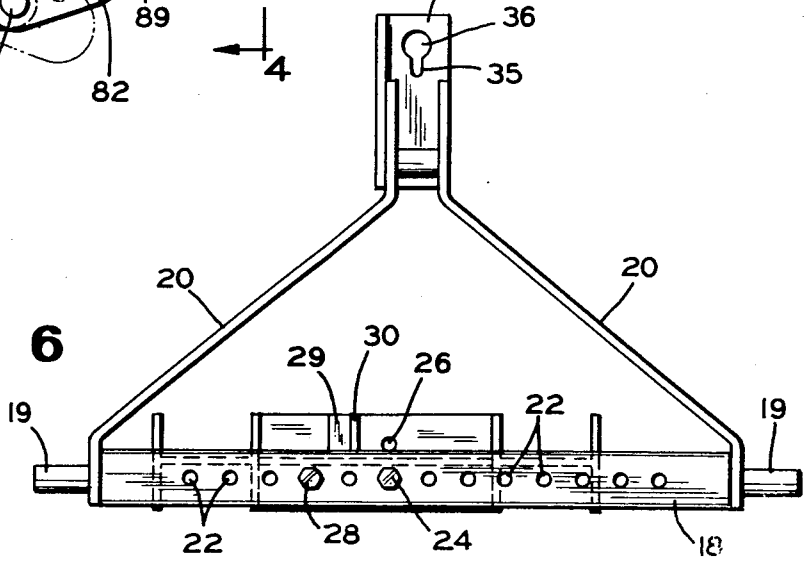
FIG. 6 is an end view as from the left in FIG. 1 and illustrating the device in the tree felling position.

As shown in FIGS. 1 and 6, the framework 12 is adapted to be affixed to the hitch bar 18 of a three point drawbar lift assembly 11 as conventionally provided upon present day tractors. It is fully contemplated, of course, that with slight modification the framework might as well be affixed to a conventional two point or other tractor hitch mechanism. More particularly, the hitch bar 18 is pivotally carried at its ends by spindles 19 extending through openings in braces 20 and lift arms 21 of the drawbar lift assembly 11 in the usual manner, so as to be rotatable about its longitudinal axis. The hitch bar 18 is conventionally provided with a series of spaced openings 22 for attaching various implements to the tractor.

To that end, the flange of the forward end beam 16 of the framework 12 is provided with an opening 23 offset from the web of the beam. The device 10 is thus attached to the drawbar lift assembly 11 by a bolt 24 extending through the openings 22 and 23 and secured loosely as by a lock nut 25 so that it may be rotated about the bolt between vertical and horizontal positions as will be hereinafter explained. A second opening 26, provided in the flange of the beam 16 on the opposite side of the web and transversely aligned with the opening 23, is positioned so as to be aligned with another of the openings 22 in the hitch bar 18 with the framework 12 in the vertical position. The aligned openings 23 and 26 are thus adapted to receive a bolt or pin (not shown) for securing the framework in the vertical position as shown in FIG. 1.

In order to convert the device from the vertical cutting and splitting configuration to the horizontal tree felling configuration, this bolt is removed and the framework is pivotted about the bolt 24. To secure the framework in the horizontal configuration a third opening 27, longitudinally aligned with the opening 23, is provided in the flange of the end beam 16. As shown in FIG. 6, the opening 27 is positioned so as to be aligned with another of the openings 23 with the framework in the horizontal position, whereby a bolt or pin 28 may be removeably inserted through the aligned openings to secure the device in this position. The bolt or pin 28 may, of course, be employed in either of the openings 26 and 27 to secure the framework in the vertical or horizontal configuration as desired.

To assist in aligning the openings 26 or 27 with the appropriate one of the spaced openings 22 for insertion of the bolt or pin 28, there is affixed to the outer surface of the flange of the end beam 16 a stop member 29 preferably in the form of a short section of angle stock. Thus, as illustrated in FIG. 6, when the framework 12 is to be moved to the horizontal position for felling timber it is rotated until the end of the angle stop member engages the edge of the hitch bar 18, at which point the opening 27 and one of the openings 23 will be aligned for reception of the pin 28. Conversely, when the framework is returned to the vertical position it is rotated about the bolt 24 in the opposite direction until the projecting flange 30 of the stop member engages the edge of the hitch bar, whereupon the opening 26 and one of the openings 23 will be aligned for reception of the pin 28.

The spindles 19 are freely rotatable within the openings in the braces 20 and lift arms 21 so that the hitch bar 18 is pivotable about its longitudinal axis. In order to permit the framework 12 to be carried in the desired angular attitude at any selected elevation in both the tree felling mode and the cutting and splitting mode, there is provided an adjustable length tie mechanism, identified generally at 31 in FIG. 1. More particularly, the tie mechanism may include a length of link chain 32 secured at one end to an eye bolt 33 affixed to one of the channel sections 17. There is suitably affixed to the drawbar lift assembly 11 a bracket 34 having a bayonet slot 35 therein with an enlarged eye 36 at its upper end. The forward end of the chain 32 is thus inserted through the enlarged eye 36, and the appropriate individual link of the chain is lodged in the bayonet slot 35 to carry the framework 12 in the desired angular attitude. The effective length of the tie mechanism 31, and hence the angle at which the framework is carried, may be changed by merely lowering the drawbar lift assembly 11 until the framework rests upon the ground so as to produce slack in the chain 32, and then adjusting the chain length by placing the appropriate link in the bayonet slot.

Figure 3:
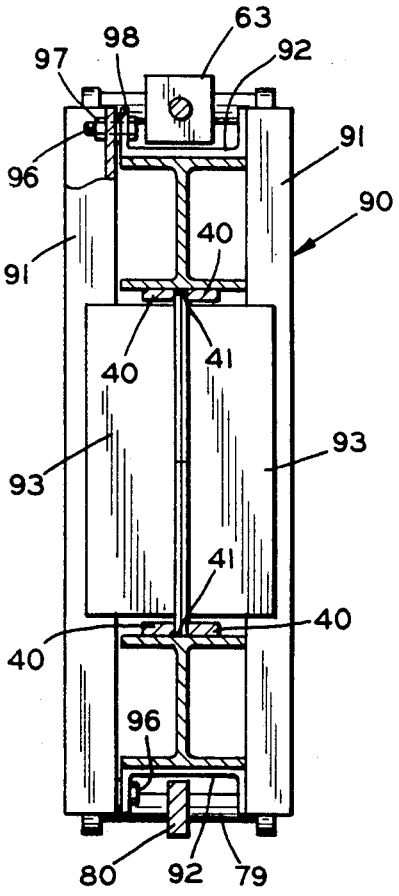
FIG. 3 is a transverse section taken substantially along line 3—3 of FIG. 2.
Figure 4:
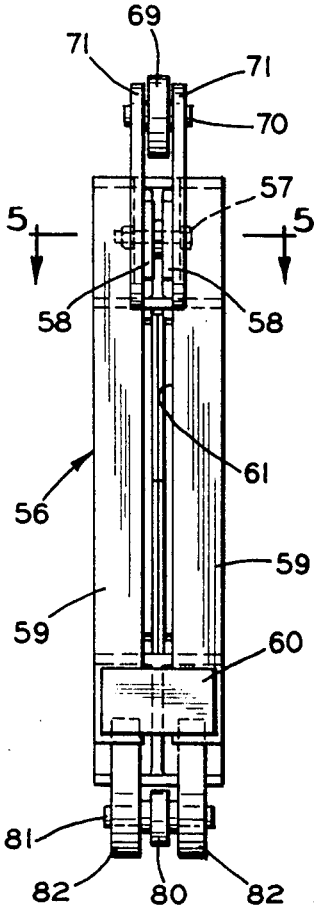
FIG. 4 is an end view taken substantially along line 4—4 of FIG. 2.
Figure 5:
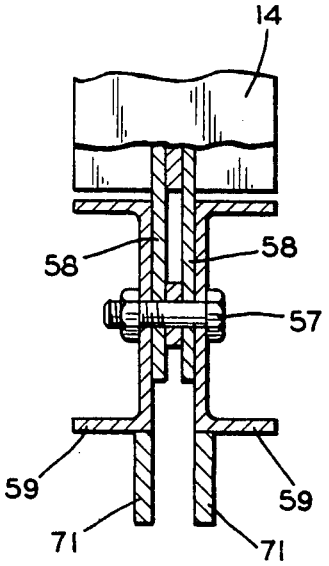
FIG. 5 is a fragmentary sectional view taken substantially along line 5—5 of FIG. 4.
Figure 2:
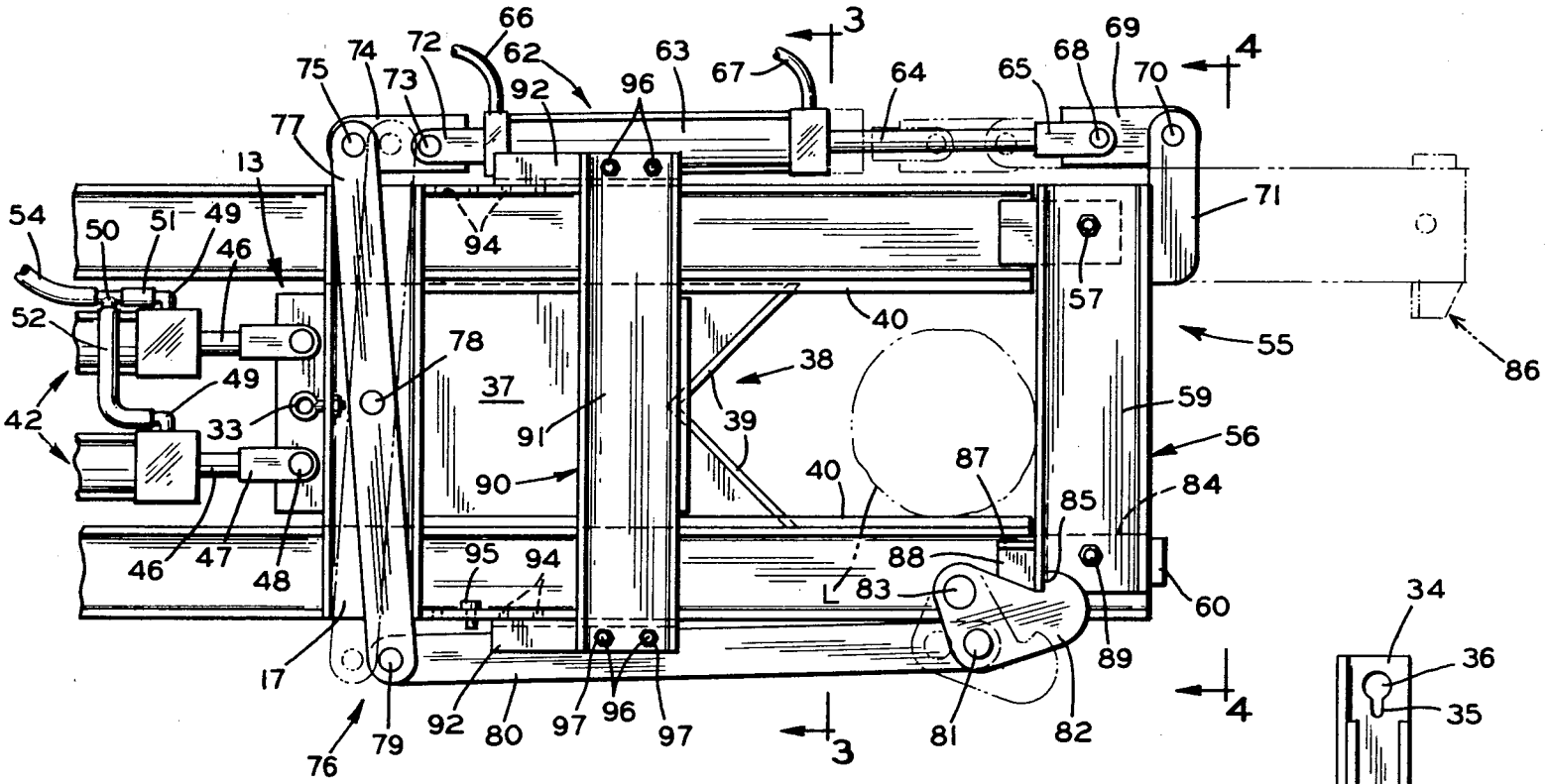
FIG. 2 is an enlarged, fragmentary plan view of the cutting end of the invention, illustrating in broken lines the alternate position of the latch mechanism and anvil for admitting a standing tree in preparation for felling.

The shearing mechanism 13, as best shown in FIGS. 1, 2 and 3, includes a planar blade 37 mounted for reciprocal movement within the framework 12 between the upper and lower beams 14 and 15, respectively. At its forward end the blade 37 includes a V-shaped notch 38, for a purpose to be hereinafter explained, with the resulting blade edges being provided with sharpened cutting surfaces 39. The blade is confined for reciprocating longitudinal movement between pairs of spaced guide bars 40 affixed to the flanges of the upper and lower beams. The guide bars and beam flanges thus define channels 41 within which the marginal edges of the blade 37 are constrained as it advances and retracts in the cutting operation as will be hereinafter described.

The blade 37 is activated by a double acting hydraulic cylinder or cylinders positioned between the rear of the blade and the forward end beam 16. While it is contemplated that a single, centrally located cylinder, for example of six inch nominal diameter with a twenty-four inch piston stroke, might be employed, the device preferably employs a pair of cylinders as illustrated in FIGS. 1 and 2. To that end, there may be provided a pair of cylinders 42, each having, for example, a four inch nominal diameter with a piston stroke of twenty-four inches. The cylinders are of a commercially available type having a yoke 43 through which a pin 44 passes for securing the cylinder end to an apertured plate 45 affixed to the end beam 16. The piston rods 46 of the cylinders include end yokes 47 secured to the blade 37 by pins 48 extending through apertures in the rear marginal edge portion thereof. Thus, as the piston rods 46 are extended the blade 37 is advanced toward the rear of the framework 12 on its cutting stroke, and as they are retracted the blade is likewise retracted.

As will be readily apparent, the cylinders are double acting, that is, the pistons are hydraulically driven on both the forward and the return stroke, and are preferably connected in parallel to the hydraulic system of the tractor to insure that equal force is applied to the blade by each cylinder. Accordingly as best shown in FIG. 2, the cylinders have a nipple at each of their ends for transmitting hydraulic fluid to and from their interior on either side of the piston (not shown) in the conventional manner. A tee coupling 50 and upper cylinder and lower cylinder coupling hoses 51 and 52, respectively, connected to the nipples, hydraulically interconnect the cylinders. The tee couplings 50, in turn, connect the piston rod extending and piston rod retracting ends of the cylinder to the hydraulic system of the tractor (not shown) in the conventional manner through hydraulic hoses 53 and 54, respectively.

At the rear or distal end of the framework 12 there is provided a retractible anvil, generally designated at 55, against which the tree or log is forced for cutting or splitting by the shearing mechanism. In cutting or splitting logs with the device in the upright, vertical position as illustrated in 1, the log L as shown in broken lines is merely inserted between the blade 37 and the anvil 55 from either side. However, in felling standing timber it is, of course, necessary to advance the device longitudinally and admit the standing tree from the end preparatory to cutting. To that end, in accordance with the invention the retractible anvil 55 includes an arm 56, pivotally mounted by a hinge pin or bolt 57 to hinge plates 58 affixed to either surface of and extending outwardly from the web of the upper beam 14, so as to be pivotable about the pin 57 between closed and open positions. The arm 56 comprises a pair of channel members 59 disposed back-to-back in spaced relation outwardly of the hinge plates 58. The channel members are interconnected adjacent their opposite or lower ends by a separator plate 60 so as to define therebetween a gap 61 within which the leading end of the advancing blade 37 is received during its cutting stroke for permitting the cutting surfaces 39 of the V-shaped notch 38 to progressively cut through the log or tree.

The retractible anvil 55 is opened and closed by means of a hydraulic actuating mechanism identified generally at 62, and including a conventional double acting hydraulic cylinder 63 having a reciprocable piston rod 64 carrying at its end a yoke 65 and coupled by hoses 66 and 67 to the hydraulic system of the tractor. As best shown in FIG. 2, the yoke 65 is connected by means of a pin 68 in the conventional manner to a connecting link 69. The connecting link, in turn, is coupled by a pin 70 to a pair of spaced arms 71 affixed as by welding to the channel members 59 of the pivotally mounted arm 56. The cylinder 63 may, for example, be a double acting cylinder having a nominal three inch diameter with a piston stroke of ten inches as conventionally employed with implements attached to farm tractors. The link 69 is so dimensioned that with the pin 68 inserted, its end engages the adjacent base wall of the yoke 65 so as to prevent pivotal movement of the link about the pin.

At its other end the cylinder 63 carries a yoke 72 connected by a pin 73 to a second connecting link 74. The connecting link 74, in turn, is coupled by a pin 75 to a toggle latch mechanism, identified generally at 76. The toggle latch mechanism comprises a pair of toggle arms 77 affixed to a shaft 78 pivotally extending through the webs of the opposed channel sections 17. Each of the toggle arms is positioned within its respective channel so that for a purpose to be described, pivotal movement of the arms on the shaft 78 is limited between the positions shown is solid and broken lines in FIG. 2 by engagement of one of their side edges with an adjacent flange of the channel. The toggle arms are connected by the pin 75 to the second connecting link 74 so as to be movable between the two positions by the cylinder 63.

The lower ends of the toggle arms are pivotally connected by means of a second shaft 79 to a lever 80. At its opposite end the lever is pivotally connected by a third shaft 81 to a pair of latch members 82, in turn pivotally mounted on the lower beam 15 by means of a spindle 83 extending through the web thereof. The upper and lower flanges of the beam 15 are appropriately removed so as to permit mounting of the latch members as well as to provide an exposed extension section 84 of the web thereof for reception in the gap 61 between the channel members 59 with the arm 56 in the closed position. The latch members 82 include fingers 85 for engaging behind the adjacent flanges of the channels 59 to lock the arm 56 in the closed position. In order to guide the web extension section 84 into the narrow gap 61 between the channel members as the arm moves from the open position as shown in broken lines in FIG. 2, to the closed position as shown in solid lines, there is provided on each of the channel members 59 on either side of the gap a guide members 86. The guide members may advantageously comprise a short section of angle stock affixed to the flange of each of the channel members adjacent the gap 61 as by welding, with a first leg 87 extending transversely of the flange and the second leg 88 extending longitudinally, with its plane diverging outwardly from the gap. The second legs 88 of the two guide members 86 thus flare outwardly from the gap and define therebetween a tapered recess for assuring that the extension section 84 is properly inserted between the channel members 59 as the arm 56 swings to the closed position preparatory to locking by the latch members 82.

In some instances the device may be employed merely for cutting and splitting logs, so that operation of the retractible anvil 55 is not required. In that event, means is provided for locking the arm 56 in the closed position without use of the hydraulic activating mechanism 62. Thus, a locking pin 89 may be inserted through aligned openings in the webs of the channel members 55 and the extension section 84 to secure the arm without use of the latch members 82. When so utilized the hydraulic cylinder 63 is not required and may, if desired, be removed by merely removing the pins 68 and 73.

In cutting and splitting wood with various devices it has been found that upon occasion a particularly tough segment, such as a knotty area, will be encountered which will thwart operation of the device and may actually result in the log becoming stuck or jammed in the cutting or splitting mechanism. In those instances it may be necessary to retract the mechanism and rotate or move the log endwise to cut or split it in a different direction or location. To assist in releasing the log in those situations, as well as to laterally stabilize the blade 37, there is provided in accordance with the invention a saddle, indicated generally at 90, which is moveable along the rectangular framework 12. As best shown in FIGS. 1, 2, and 3, the saddle comprises a boxlike framework including outwardly facing, transversely extending channel section 91 on either side of the framework 12, secured at their upper and lower ends to outwardly facing stub channel members 92 whose webs extend along the outer flanges of the upper and lower beams 14 and 15, respectively. The saddle is adapted to slide longitudinally back and forth along the framework 12, with the upper stub channel member accomodating and passing beneath the cylinder 63 without obstruction. Affixed to the flange of each transverse channel 91 facing the retractible anvil 55 is a stabilizer plate 93. As will be readily apparent in FIG. 3, the stabilizer plates extend into the area between the guide bars on the upper and lower beams 14 and 15 and, for a purpose to be hereinafter more fully explained, their inner side edges engage the opposite surfaces of the blade 37.

As indicated above, the stabilizer plates 93 and saddle 90 serve a dual function. To that end, the four channel members that comprise the saddle are of such dimensions and so assembled that with the stabilizer plates in engagement with the blade 37, the saddle will slide freely along the rectangular framework 12 guided by the stub channel members 92 and the transverse channels 91. The stabilizer plates 93 are adjustably urged or clamped against the blade 37 so that the saddle will normally move back and forth with or "follow" the blade during the cutting or splitting cycle. Upon the forward cutting or splitting stroke the saddle will advance with the blade until the stabilizer plates engage the log. The blade will then slide between the stabilizer plates until it has cut through or split the log. Since the stabilizer plates are in continuous engagement with the blade they restrain it from buckling or bowing to the side should it tend to do so due to extreme forces during the cutting.

Upon retraction of the shearing mechanism 13 the saddle will return with the blade 37. Should the blade 37 become stuck in the log upon the advancing cutting or splitting stroke as aforementioned, the log will be pulled back with the blade as it is retracted. Means is provided for limiting the return travel of the saddle whereby upon engaging a suitable stop means upon the framework 12, the saddle will be restrained so that the blade may be completely withdrawn through the stabilizer plates to dislodge the log. It will be appreciated that for efficient use of time the distance the blade must travel in each cutting or splitting cycle should be minimized. Thus, the blade is generally retracted only to the extent necessary to insert the log or tree between the cutting surfaces 39 and the anvil 55 for cutting or splitting. In splitting logs longitudinally the blade is generally retracted upon the return stroke so that the forward, cutting end is at a considerably greater distance from the anvil than is necessary for the transverse cutting of logs. It is thus desirable to be able to stop the saddle 90 at selected positions along the framework 12 upon the return stroke in order to adapt the device to both longitudinal splitting and transverse cutting, as well as to accomodate logs of different diameters. To that end, the aforementioned stop means may advantageously comprise a series of openings 94 spaced along the outer flange of either or both of the upper and lower beam 14 and 15, respectively, for selectively receiving a positioning pin 95 behind the stub channel member 92 of the saddle 90. The end of the channel member will thus engage the appropriately located positioning pin so as to limit travel of the saddle at the desired location upon the return stroke.

In order to have the saddle 90 follow or travel with the shearing mechanism 13 while permitting the blade 37 to slip between the stabilizer plates 93 as appropriate in the aforementioned manner, means is provided for suitably adjusting the compressive force with which the stabilizer plates engage the opposite surfaces of the blade. Thus, the stabilizer plates may be securely affixed to their respective tranverse channel 91 as by welding. One of the transverse channels, for example the channel on the far side as viewed in FIG. 2, may likewise be secured to the stub channel members 92 by welding. The other, or near, transverse channel 91 is secured to the stub channel members 92 as by bolts. More particularly, threaded fasteners 96 having nuts 97 extend through openings in the web of the transverse channel and the adjacent flange of the stub channel members. Washers or shims 98 are provided on the fasteners 96 between the transverse channel 91 and stub channel members 92 as necessary to maintain appropriate clearance between the transverse channel and beams 14 and 15. The threaded fasteners may be provided with lock washers or lock nuts (not shown) in the usual manner if necessary. Thus, by manipulation of the nuts 97 and appropriate use of the shims 98, proper compressive force may be applied on the blade 37 by the stabilizer plates 93 to cause the saddle to function in the aforementioned manner.

Reviewing briefly operation of the invention, with the device mounted upon the drawbar lift assembly of the tractor, if it is to be used for felling a standing tree the framework 12 is rotated about the bolt 24 and locked in the horizontal position by the bolt or pin 28 as illustrated in FIG. 6. The link chain 32 is appropriately positioned in the bayonet slot 35 to carry the framework in the desired angular position, and the actuating mechanism 62 is operated to unlatch and retract the arm 56. The tractor is backed into position whereby the standing tree is received within the open end of the device, and the actuating mechanism is operated to close and latch the arm 56. The chain 32 may be lengthened, or completely released from, the slot 35. The blade 37 is then advanced to bring the cutting surfaces 39 of the V-shaped notch 38 into engagement with the tree. As the blade pushes the tree against the arm 56 and begins cutting through the tree, the drawbar lift assembly 11 may be raised to elevate the forward end of the rectangular framework 12 so as to tilt the tree rearwardly and cause it to fall away from the tractor as it is severed by the blade.

When it is desired to employ the device in cutting or splitting logs, the framework 12 is generally rotated to the vertical position as illustrated in FIG. 1. For such use the arm 56 may be secured by the locking pin 89 and the hydraulic cylinder 63 dispensed with if desired. With the blade 37 retracted and the arm 56 closed, the log L is inserted for either transverse cutting or longitudinal splitting as the case may be. The blade 37 is then advanced by the piston rods 46 of the cylinders 42, with the saddle 90 being carried along due to the engagement of the blade by the stabilizer plates 93. The log is forced against the anvil 55 and progressively severed in opposed directions by the cutting surfaces 39 of the V-shaped notch 38. When and if the stabilizer plates 93 engage the log the saddle 90 stops and the blade continues to advance therethrough and into the gap 61 until the log is completely severed. Should the log become jammed or stuck upon the blade, the saddle will move rearwardly with the blade upon its retraction until the stub channel members 92 engage the stop means or positioning pin 95. The saddle will then stop and the blade will continue to be withdrawn through the stabilizer plates to dislodge the log from the blade. Of course, in normal operation when the blade cuts through the log it is only necessary to retract it sufficiently to permit insertion of the next section of log before reversing blade direction and beginning the next cutting cycle.

It is to be understood that the form of the invention herewith shown and described is to be taken as an illustrative embodiment only of the same, and that various changes in the shape, size and arrangement of the parts may be resorted to without departing from the spirit of the invention.

I claim:

1. A tree felling and log cutting and splitting apparatus for attachment to the rear hitch of a tractor, comprising a generally rectangular framework, connecting means attaching said framework at its forward end to said hitch for pivotable movement between horizontal and vertical positions, adjustable-length tie means extending between said rear hitch and said framework for carrying said framework at selected angular attitudes and heights, a shear blade mounted for reciprocating longitudinal movement within said framework, means for advancing and retracting said blade within said framework, and an anvil at the rear end of said framework against which said shear blade urges trees and logs for cutting therethrough upon its advancing stroke.

2. A tree felling and log cutting and splitting apparatus as claimed in claim 1, wherein said shear blade includes a cutting edge comprising a V-shaped notch for engaging said tree or log whereby said tree or log is stabilized against transverse movement while being severed as said blade advances toward said anvil.

3. A tree felling and log cutting and splitting apparatus as claimed in claim 2, including pairs of parallel, spaced guide bars affixed to the longitudinal members of said framework defining channels slidingly receiving the opposed marginal edges of said shear blade.

4. A tree felling and log cutting and splitting apparatus as claimed in claim 3, wherein said anvil comprises a pair of spaced frame members defining a gap therebetween for receiving the forward end of said shear blade as it is advanced to cut through said tree or log.

5. A tree felling and log cutting and splitting apparatus as claimed in claim 1, including means pivotally mounting said anvil at one end to said framework and means releasably securing said anvil at its other end to said framework whereby said anvil can be swung open for admitting a standing tree and then closed for felling of the tree.

6. A tree felling and log cutting and splitting apparatus as claimed in claim 5, wherein said means releasably securing said anvil includes latch members, and including actuating mechanism interconnecting said latch members and said anvil for sequentially disengaging said latch members and then swinging open said anvil upon an opening cycle, and closing said anvil and engaging said latch members upon a closing cycle.

7. A tree felling and log cutting and splitting apparatus as claimed in claim 6, wherein said actuating mechanism includes a toggle arm pivotally affixed to said framework intermediate its ends, means limiting the pivotting movement of said toggle arm between defined limits, a lever connecting one end of said toggle arm to said latch members, and a cylinder including a piston rod connecting the other end of said toggle arm to said anvil, whereby upon an opening cycle operation of said piston rod first pivots said toggle arm to said defined limit in one direction to disengage said latch members from said anvil and then swing said anvil to the open position, and upon a closing cycle to swing said anvil to the closed position and then pivot said toggle arm to said defined limit in the other direction to engage said latch members with said anvil.

8. A tree felling and log cutting and splitting apparatus as claimed in claim 1, including a saddle carried by said rectangular framework for movement back and forth therealong with said shear blade, said shear blade being movable relative to said saddle when said saddle engages an obstruction, and means limiting the rearward movement of said saddle at selected positions upon the rearward movement of said shear blade.

9. A tree felling and log cutting and splitting apparatus as claimed in claim 8, including at least one stabilizer plate carried by said saddle and frictionally engaging the surface of said shear blade so as to cause said saddle to normally move with said shear blade and permit said stabilizer plate to slide along said surface when said saddle engages an obstruction.

10. A tree felling and log cutting and splitting apparatus as claimed in claim 9, wherein said saddle comprises transversely extending members on each side of said rectangular framework, said transversely extending members being interconnected at each end outwardly of said framework, and including a said stabilizer plate carried by each said transversely extending members, said stabilizer plates clampingly engaging said shear blade therebetween.

11. A tree felling and log cutting and splitting apparatus as claimed in claim 10, wherein one of said stabilizer plates is rigidly affixed to its associated transversely extending member and the other said stabilizer plate is adjustably mounted upon its associated transversely extending member for permitting adjustment of the clamping pressure upon said shear blade.

12. A tree felling and log cutting and splitting apparatus as claimed in claim 1, wherein said rear hitch is vertically moveable and includes a transversely extending hitch bar to which said forward end of said rectangular framework is pivotably attached by said connecting means, said hitch bar being rotatable about its longitudinal axis to provide, with said adjustable length tie means, for carrying said framework at said selected angular attitudes and heights.

13. A tree felling and log cutting and splitting apparatus as claimed in claim 12, including openings in said hitch and said rectangular framework adapted to be aligned for receiving locking means therethrough with said rectangular framework in said horizontal and vertical positions, and a stop member on said rectangular framework engaging said hitch with said rectangular framework in said horizontal and vertical positions with said openings axially aligned.

14. A tree felling and log cutting and splitting apparatus as claimed in claim 4, including means pivotably mounting said anvil at one end to said framework and means releasably securing said anvil at its other end to said framework whereby said anvil can be swung open for admitting a standing tree and then closed for felling of the tree, and means releasably securing said anvil including latch members and actuating mechanism interconnecting said latch members and said anvil for sequentially disengaging said latch members and then swinging open said anvil upon an opening cycle, and closing said anvil and engaging said latch members upon a closing cycle.

15. A tree felling and log cutting and splitting apparatus as claimed in claim 4, including a saddle carried by said rectangular framework for movement back and forth therealong with said shear blade, said shear blade being moveable relative to said saddle when said saddle engages an obstruction, and means limiting the rearward movement of said saddle at selected positions upon the rearward movement of said shear blade.

16. A tree felling and log cutting and splitting apparatus as claimed in claim 14, including a saddle carried by said rectangular framework for movement back and forth therealong with said shear blade, said shear blade being moveable relative to said saddle when said saddle engages an obstruction, and means limiting the rearward movement of said saddle at selected positions upon the rearward movement of said shear blade.

17. A tree felling and log cutting and splitting apparatus as claimed in claim 16, including stabilizer plates carried by said saddle on opposite sides of said shear blade and clampingly engaging said shear blade therebetween to cause said saddle to normally move with said shear blade and permit said stabilizer plates to slide along the surfaces of said shear blade when said saddle engages an obstruction.

* * * * *